US006832897B2

(12) United States Patent
Urban

(10) Patent No.: US 6,832,897 B2
(45) Date of Patent: Dec. 21, 2004

(54) SECOND STAGE TURBINE BUCKET AIRFOIL

(75) Inventor: John Paul Urban, Greer, SC (US)

(73) Assignee: General Electric Company, Schenectady, NY (US)

( * ) Notice: Subject to any disclaimer, the term of this patent is extended or adjusted under 35 U.S.C. 154(b) by 19 days.

(21) Appl. No.: 10/430,326

(22) Filed: May 7, 2003

(65) Prior Publication Data

US 2004/0223849 A1 Nov. 11, 2004

(51) Int. Cl.[7] ..... F01D 5/14
(52) U.S. Cl. ..... 416/223 A; 416/243; 416/DIG. 2
(58) Field of Search ..... 416/223 R, 243, 416/223 A, DIG. 2, DIG. 5; 415/191, 193, 208.2, 211.2

(56) References Cited

U.S. PATENT DOCUMENTS 5,980,209 A * 11/1999 Barry et al. ..... 416/223 A
6,450,770 B1 * 9/2002 Wang et al. ..... 416/223 A
6,461,109 B1 * 10/2002 Wedlake et al. ..... 416/223 R

* cited by examiner

*Primary Examiner*—Ninh H. Nguyen
(74) *Attorney, Agent, or Firm*—Nixon & Vanderhye P.C.

(57) ABSTRACT

The second stage buckets have airfoil profiles substantially in accordance with Cartesian coordinate values of X, Y and Z set forth Table I wherein X, Y and Z values are in inches. Z represents a distance in inches from and perpendicular to a plane passing through the engine centerline. X and Y are distances in inches which, when connected by smooth continuous arcs, define airfoil profile sections at each distance Z. The profile sections at the Z distances are joined smoothly with one another to form the complete airfoil shape. The X and Y distances and optionally the Z distance may be scalable as a function of the same constant or number to provide a scaled up or scaled down airfoil section for the bucket. The nominal airfoil given by the X, Y and Z distances lies within an envelop of ±0.016 inches.

20 Claims, 7 Drawing Sheets

SECOND STAGE TURBINE BUCKET AIRFOIL

BACKGROUND OF THE INVENTION

The present invention relates to a turbine bucket for a gas turbine stage and particularly relates to a second stage turbine bucket airfoil profile.

There are many considerations in the design and construction of turbine buckets, particularly their airfoils, including optimized aerodynamic efficiency and aerodynamic and mechanical bucket loading. Additionally, bucket airfoil design must also take into consideration the potential mismatch or engagement problems associated with bucket airfoils having tip shrouds. As will be appreciated, certain buckets in turbines are provided with bucket tip shrouds which circumferentially engage one another along leading and trailing edges in a circumferential direction. Typically, the shrouds mount a seal which cooperates with a fixed shroud to seal against hot gas bypass between high and lower pressure regions on opposite sides of the bucket airfoils. The shrouds are also provided on long and slender buckets to add stiffness to the bucket airfoils by the engagement of the shrouds with one another. However, with air-cooled buckets, differential thermal growth and twisting sometimes affords poor engagement of the shrouds with one another. That is, one edge of the shroud may be radially inwardly of the opposing edge of the adjacent shroud. Absent an ideal engagement between adjacent shrouds, adverse loading causes higher stress at points of contact. With loss or minimization of contact, the benefit of damping vibrations to avoid high cycle fatigue by using shrouds is minimized or lost. Less than optimum tip shroud engagement adversely impacts tip shroud creep life and reduces part life. It will also be appreciated that the failure of a single bucket including its airfoil causes the entire turbine to be taken offline. These are time-consuming and expensive repairs which include the cost of the outage to the user of the turbine.

BRIEF DESCRIPTION OF THE INVENTION

In accordance with a preferred embodiment of the present invention, there is provided a unique turbine bucket airfoil profile, preferably for air-cooled tip shrouded airfoils of the second stage of a gas turbine. The bucket airfoil profile yields substantially improved shroud-to-shroud engagement enabling significant increased part life and reduced repair costs. Additionally, the airfoil reduces local creep and affords improved HCF margin in the resulting airfoil. The bucket airfoil profile is defined by a unique loci of points to achieve the necessary efficiency, loading and tip shroud engagement requirements. These unique loci of points define the nominal airfoil profile ranging from 10–90% span of the airfoil height and are identified by the X, Y and Z Cartesian coordinates of Table I which follows. The points for the coordinate values shown in Table I are for a cold, i.e., room temperature profile at various cross-sections of the bucket airfoil within the 10–90% span of the airfoil height. The X, Y and Z coordinates are given in distance dimensions, e.g., units of inches. The X and Y coordinate values are joined smoothly with one another at each Z location to form smooth continuous arcuate airfoil profile sections. The Z coordinates are distances from and perpendicular to a plane passing through a turbine axis of rotation. Each defined airfoil profile section at each Z distance is joined smoothly with adjacent airfoil profile sections to form the complete airfoil shape.

It will be appreciated that as each bucket airfoil heats up in use, the profile will change as a result of stress and temperature. Thus, the cold or room temperature profile is given by the X, Y and Z coordinates for manufacturing purposes. Because a manufactured bucket airfoil profile may be different from the nominal airfoil profile given by the following table, a distance of plus or minus 0.016 inches from the nominal profile in a direction normal to any surface location along the nominal profile and which includes any coating process, defines the profile envelope for this bucket airfoil. The design is robust to this variation without impairment of the mechanical and aerodynamic functions.

It will also be appreciated that the airfoil can be scaled up or scaled down geometrically for introduction into similar turbine designs. Consequently, the X and Y coordinates in inches of the nominal airfoil profile given below are a function of the same constant or number. That is, the X and Y, and optionally the Z, coordinate values in inches may be multiplied or divided by the same constant or number to provide a scaled up or scaled down version of the bucket airfoil profile while retaining the airfoil section shape.

In a preferred embodiment according to the present invention, there is provided a turbine bucket including a bucket airfoil having an airfoil shape, the airfoil having nominal profile ranging from 10–90% span of the airfoil height substantially in accordance with Cartesian coordinate values of X, Y and Z set forth in Table I wherein Z is a distance in inches from and perpendicular to a plane passing through an axis of rotation of the turbine and wherein X and Y are distances in inches which, when connected by smooth continuing arcs, define airfoil profile sections at each distance Z, the profile sections at the Z distance being joined smoothly with one another to form the complete airfoil shape.

In a further preferred embodiment according to the present invention, there is provided a turbine bucket including a bucket airfoil having an airfoil shape, the airfoil having an uncoated nominal airfoil profile ranging from 10–90% span of the airfoil height substantially in accordance with Cartesian coordinate values of X, Y and Z set forth in Table I wherein Z is a distance in inches from and perpendicular to a plane passing through an axis of rotation of the turbine and wherein X and Y are distances in inches which, when connected by smooth continuing arcs, define airfoil profile sections at each distance Z, the profile sections at the Z distances being joined smoothly with one another to form the complete airfoil shape, the X and Y distances being scalable as a function of the same constant to provide a scaled-up or scaled-down bucket airfoil.

In a further preferred embodiment according to the present invention, there is provided a turbine comprising a turbine wheel having a plurality of buckets, each of the buckets including a bucket airfoil having an airfoil shape, the airfoil having a nominal profile ranging from 10–90% span of the airfoil height substantially in accordance with Cartesian coordinate values of X, Y and Z set forth in Table I wherein Z is a distance in inches from and perpendicular to a plane passing through an axis of rotation of the turbine axis and wherein X and Y are distances in inches which, when connected by smooth continuous arcs, define airfoil profile sections at each distance Z, the profile sections at the Z distances being joined smoothly with one another to form the complete airfoil shape.

In a further preferred embodiment according to the present invention, there is provided a turbine comprising a turbine wheel having a plurality of buckets, each of the buckets including a bucket airfoil having an airfoil shape, the airfoil having a nominal profile ranging from 10–90% span of the airfoil height substantially in accordance with Cartesian coordinate values of X, Y and Z set forth in Table I wherein Z is a distance in inches from and perpendicular to a plane passing through an axis of rotation of the turbine and wherein X and Y are distances in inches which, when connected by smooth continuous arcs, define airfoil profile sections at each distance Z, the profile sections at the Z distances being joined smoothly with one another to form the complete airfoil shape, the X and Y distances being scalable as a function of the same constant to provide a scaled-up or scaled-down bucket airfoil.

DETAILED DESCRIPTION OF THE INVENTION

Figure 1:
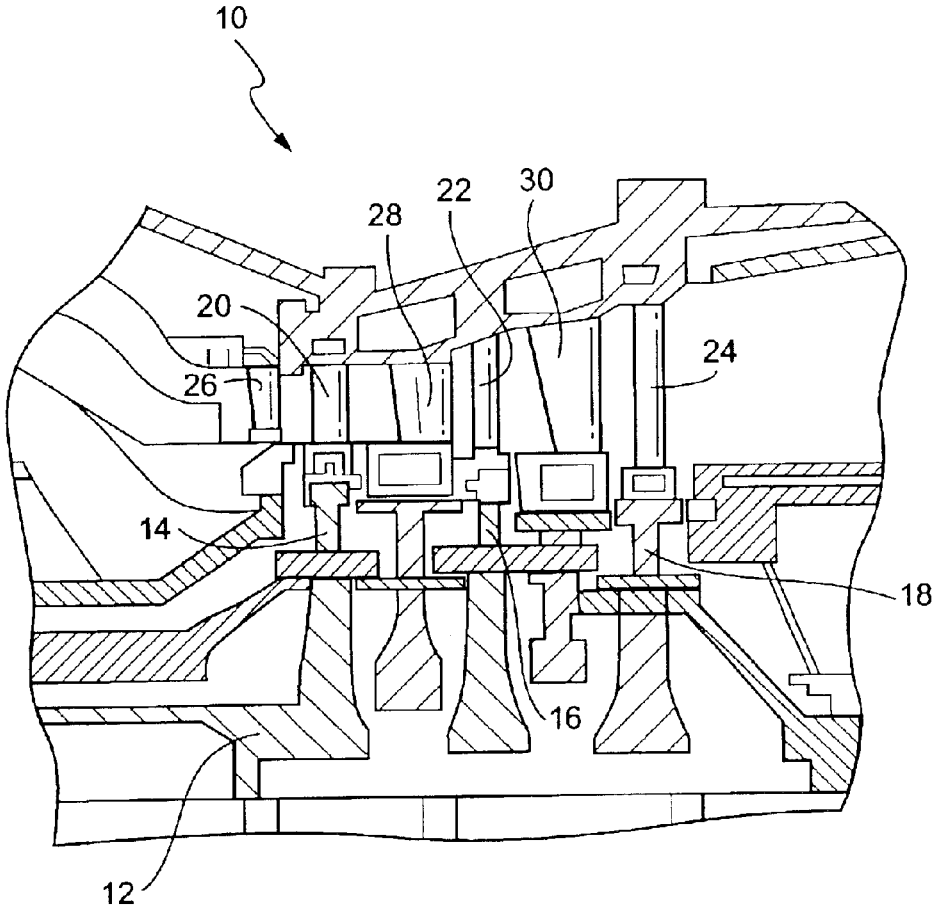
FIG. 1 is a generalized schematic illustration of a turbine having a second stage turbine wheel employing the buckets and bucket airfoils hereof.

Referring now to FIG. 1, there is illustrated a portion of a turbine generally designated 10 in which a second stage turbine bucket 22 having an airfoil profile 23 as defined herein may be utilized. Turbine 10 includes a rotor 12 having first, second and third stage rotor wheels 14, 16 and 18 having buckets 20, 22 and 24 in conjunction with the respective stator vanes 26, 28 and 30 of the various stages of the rotor. It will be appreciated that a three stage turbine is illustrated.

The second stage comprises the rotor wheel 16 on which buckets 22 are mounted in axial opposition to the upstream stator vanes 28. It will be appreciated that a plurality of the buckets 22 are spaced circumferentially one from the other about the second stage wheel 16 and in this instance there are ninety-two buckets mounted on the second stage wheel 16.

Figure 5:
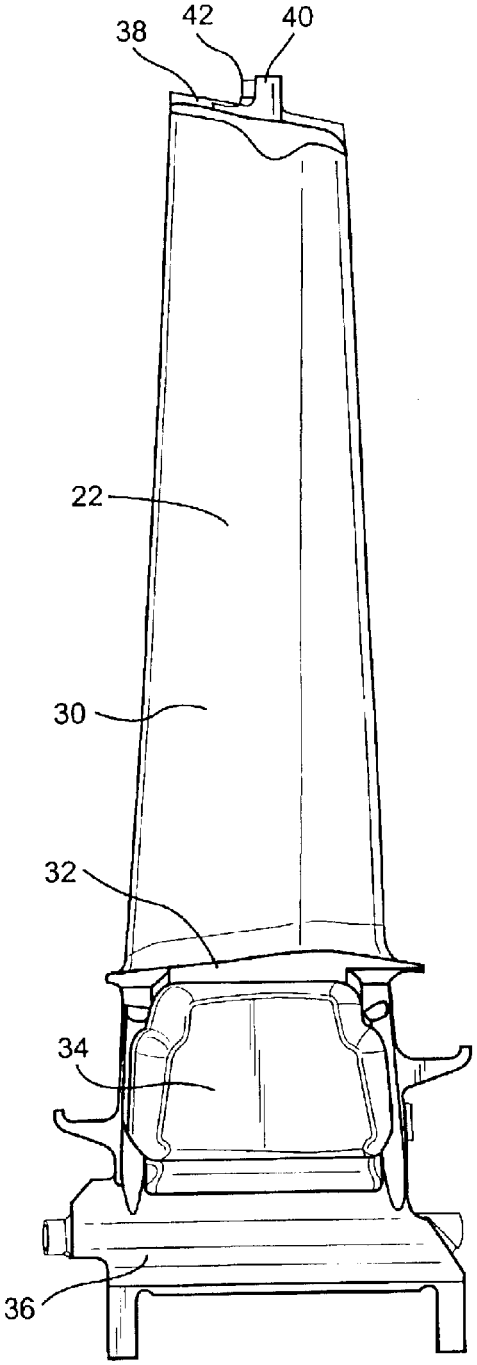
FIG. 5 is an elevational view of the bucket hereof similarly as indicated in FIG. 3 and taken from the opposite side thereof.
Figure 6:
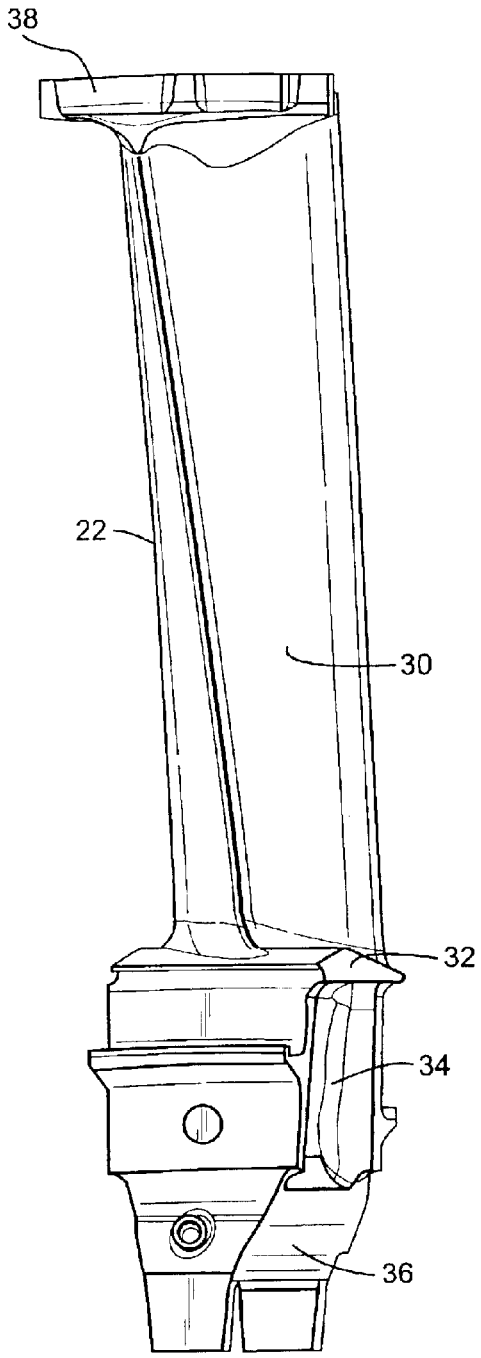
FIG. 6 is an axial view of the bucket as it would appear in the turbine wheel and viewed from the leading edge.
Figure 7:
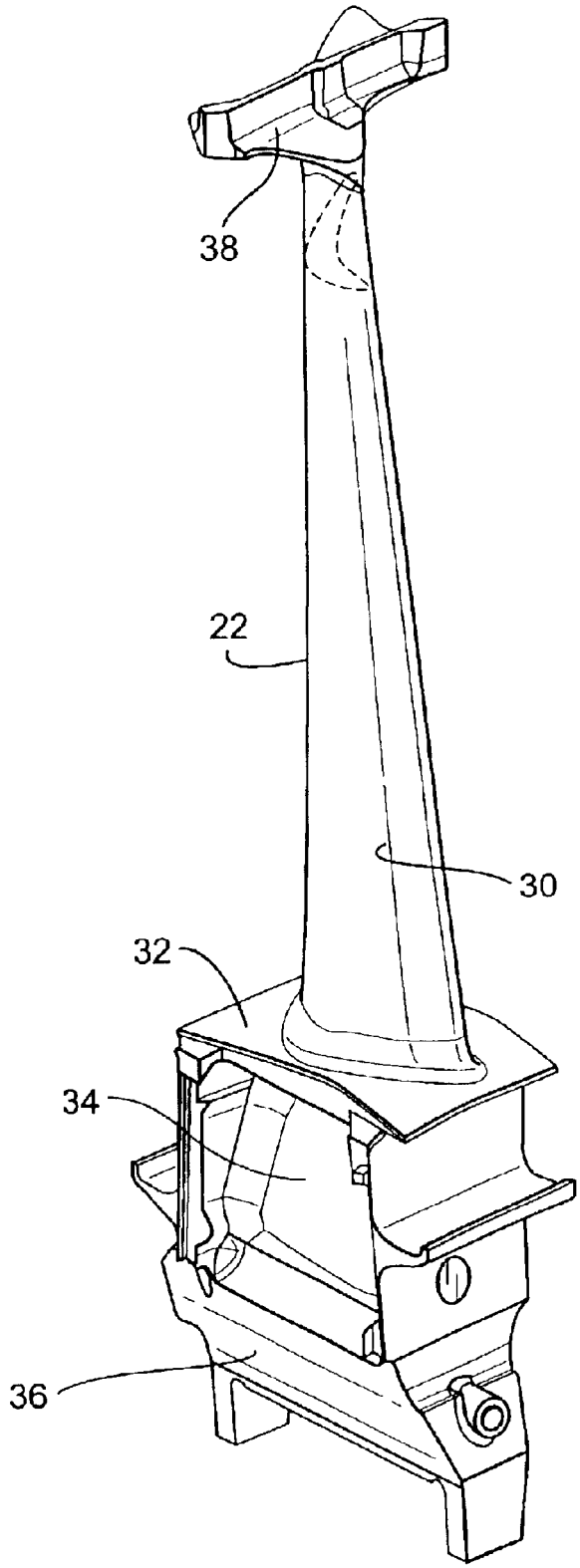
FIG. 7 is a perspective view of the bucket hereof.

Referring now to FIGS. 5 and 6, there are illustrated buckets 22 of the second stage. Each bucket 22 includes a bucket airfoil 30 mounted on a platform 32, the bucket further including a shank 34 and a dovetail 36. Adjacent the tip of the airfoil 30 is a shroud 38 mounting a seal 40 and a cutter tooth 42. The shroud 38 lies in radial opposition to a fixed shroud forming part of the stationary casing of the turbine. The seals 40 are provided to seal between high and lower pressure regions on opposite sides of the airfoils which lie in the hot gas path of the turbine. The cutter tooth 42 on each shroud typically forms a wider groove in the fixed shroud to permit slight leakage flows past the seal 40.

Figure 2:
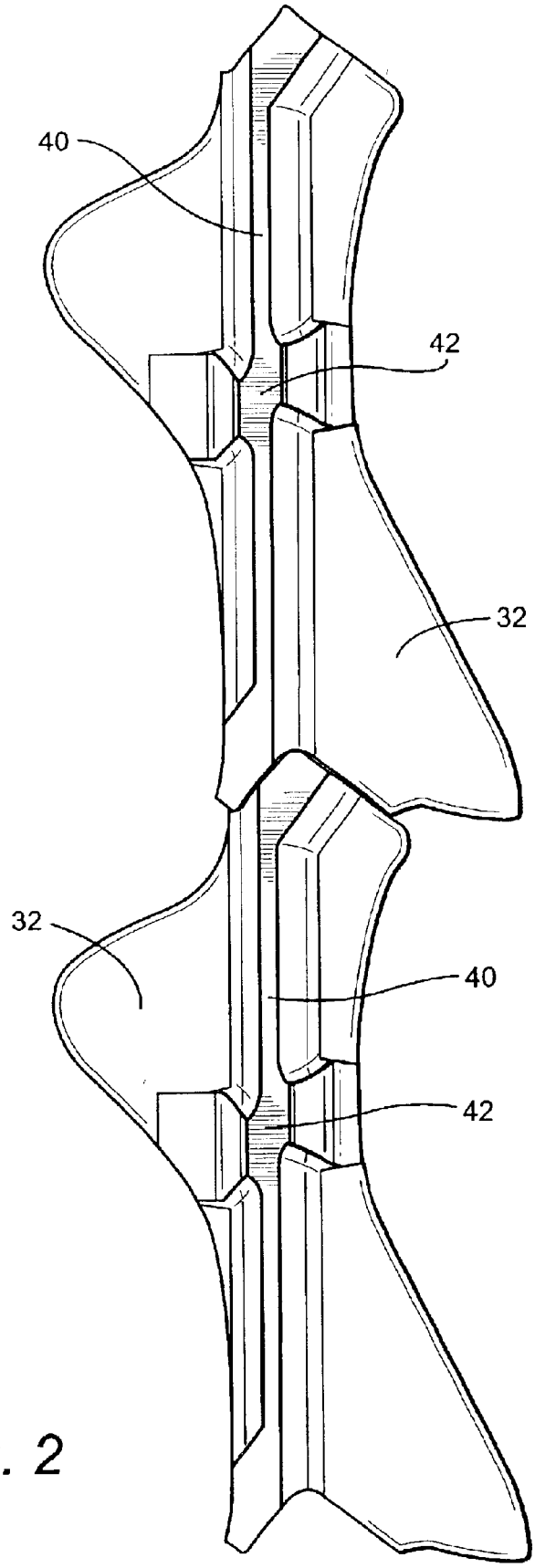
FIG. 2 is an end view of the shrouds formed on the bucket airfoils as viewed looking radially inwardly.
Figure 3:
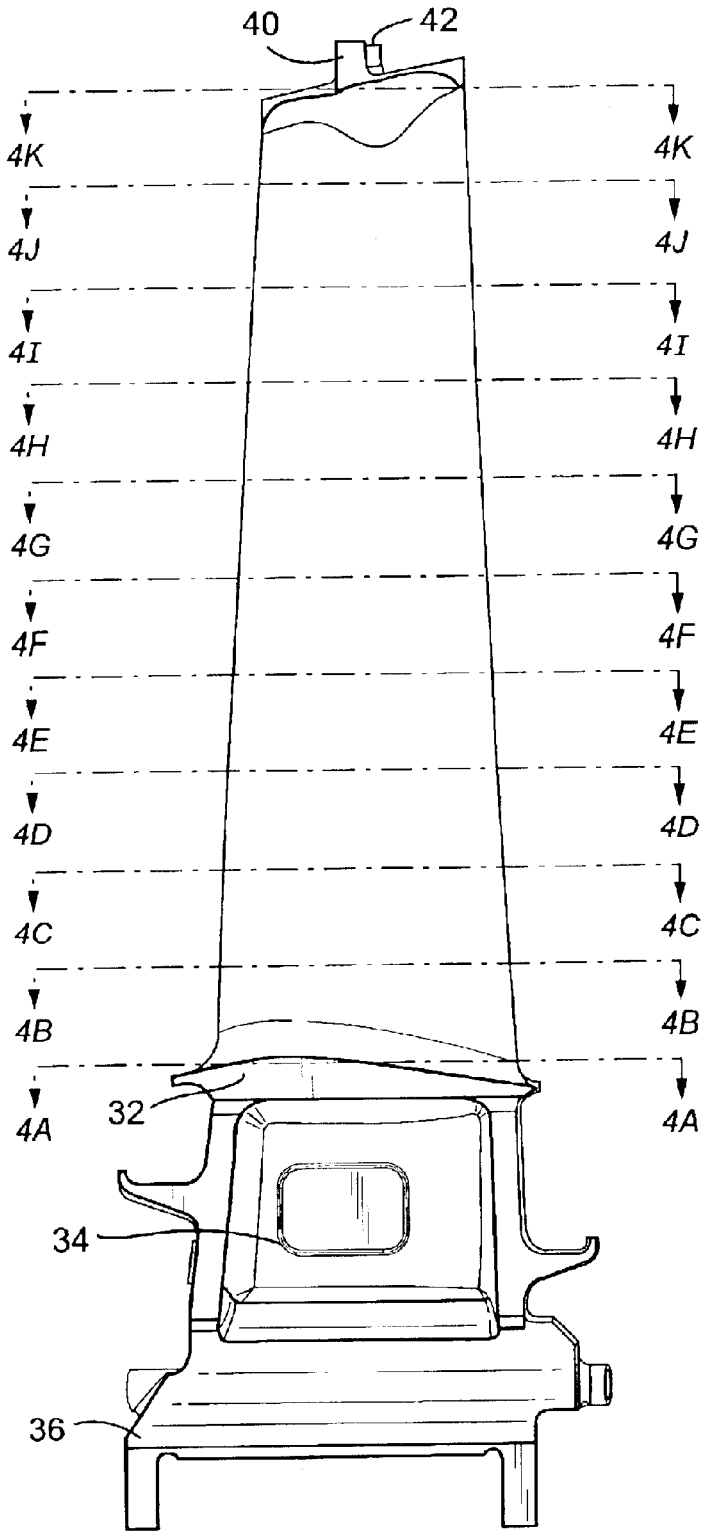
FIG. 3 is a side elevational view of a preferred embodiment of the bucket hereof.
Figure 4A:
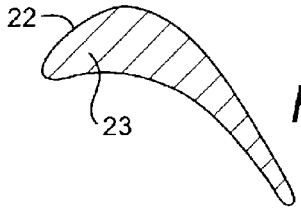
FIGS. 4A–4K are representative cross-sectional views taken generally about on the lines variously indicated in FIG. 3.
Figure 4B:
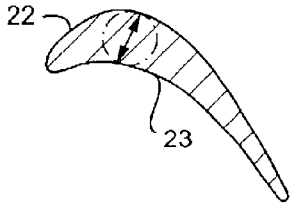
Figure 4C:
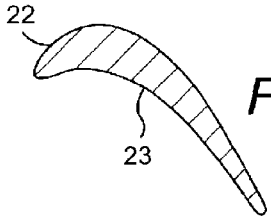
Figure 4D:
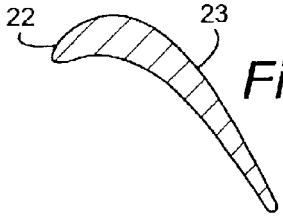
Figure 4E:
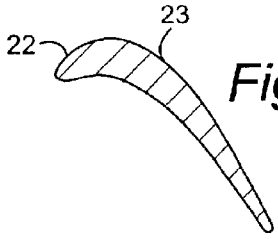
Figure 4F:
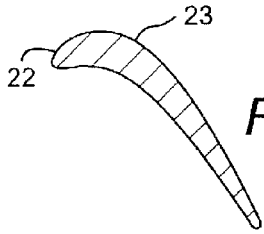
Figure 4G:
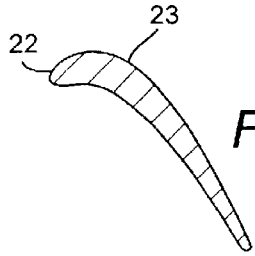
Figure 4H:
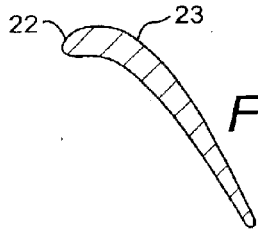
Figure 4I:
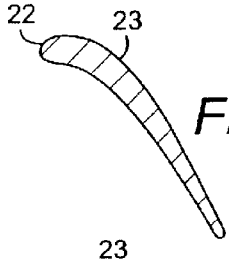
Figure 4J:
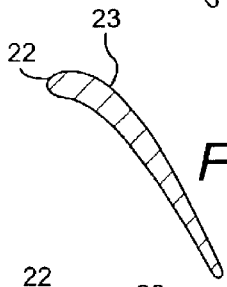
Figure 4K:
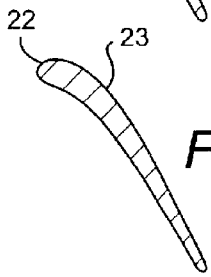
Figure 8:
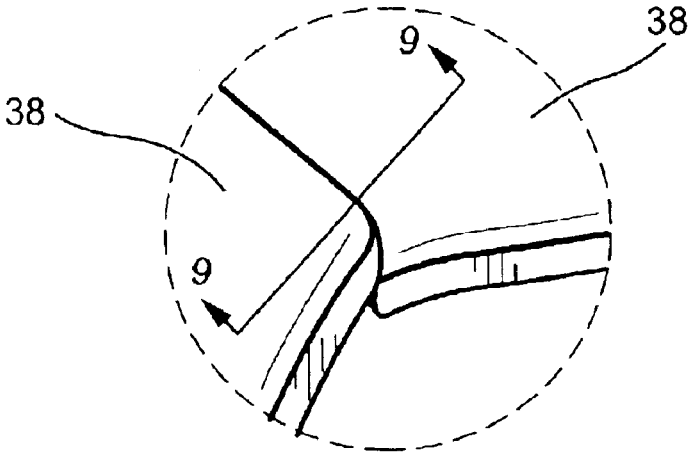
FIG. 8 is a perspective view of the engagement between adjacent shrouds in a misaligned condition.
Figure 9:
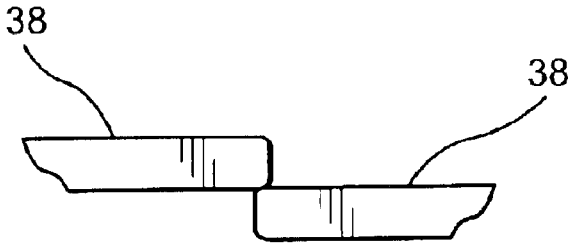
FIG. 9 is a schematic representation of misengaged shrouds, i.e., shingled shrouds.

Referring to FIGS. 2, 8 and 9, the shrouds 38 have leading and trailing edges in a circumferential direction which engage the trailing and leading edges, respectively, of adjacent shrouds. The shrouds are not mechanically connected one to the other but are shaped to maintain engagement. It has been discovered that the leading and trailing edges of adjacent shrouds may have engagements which mismatch, which among other things, adversely impact the part life. For example, the shrouds may have a tendency to shingle relative to one another. That is, the trailing edge of one shroud may overlie or underlie the leading edge of an adjacent shroud, as illustrated in FIGS. 8 and 9, with adverse consequences. The bucket airfoil has particular effect on the shroud engagement and the present airfoil profile reduces local creep and increases high cycle fatigue margin in the airfoil, ultimately leading to higher part life.

A Cartesian coordinate system of X, Y and Z values given in Table I defines the profile of airfoil 30. The coordinate values for the X, Y and Z coordinates are set forth in inches in Table I although other units of dimensions may be used. The Cartesian coordinate system has orthogonally-related X, Y and Z axes. The Z axis extends perpendicular to a plane passing through the axis of rotation of the turbine rotor and normal to a plane containing the X and Y values, The coordinate values for Z in Table I represent distances in inches from and perpendicular to a plane passing through the axis of rotation of the turbine. The X axis extends in a direction parallel to the turbine rotor centerline and the Y axis extends in a tangential direction.

By defining X and Y coordinate values at selected locations in a Z direction normal to the X, Y plane, the profile of airfoil 40 can be ascertained. By connecting the X and Y values with smooth continuing arcs, each profile section at each distance Z is fixed. The surface profiles of the various surface locations between the distances Z are determined by smoothly connecting the adjacent profile sections to one another to form the airfoil shape. These values represent the airfoil profiles at ambient, non-operating or non-hot conditions and are for an uncoated airfoil.

The Table I values are generated and shown to three decimal places for determining the profile of the airfoil. There are typical manufacturing tolerances as well as coatings which must be accounted for in the actual profile of the airfoil. Accordingly, the values for the profile given in Table I are for a nominal airfoil. It will therefore be appreciated that typical manufacturing tolerances, i.e., values, including any coating thicknesses, are additive to the X and Y values given in Table I below. Accordingly, a distance of ±0.016 inches in a direction normal to any surface location along the airfoil profile defines an airfoil profile envelope for this particular bucket airfoil design and turbine.

The coordinate values given in Table I below provide the preferred nominal profile envelope ranging from 10–90% span of the airfoil height.

TABLE I

| X(10%) | Y(10%) | Z(10%) | X(20%) | Y(20%) | Z(20%) |
|---|---|---|---|---|---|
| −0.4223 | 0.1413 | 40.213 | −1.456 | 0.6117 | 41.4 |
| −0.1007 | 0.8256 | 40.213 | −1.5812 | 0.2658 | 41.4 |
| −1.6189 | 0.0838 | 40.213 | −0.7133 | 0.3439 | 41.4 |
| −0.2487 | 0.5905 | 40.213 | −1.4023 | 0.2375 | 41.4 |
| −1.0913 | 0.1732 | 40.213 | −1.1368 | 0.8641 | 41.4 |
| −1.4158 | 0.081 | 40.213 | −0.4471 | 0.975 | 41.4 |
| −1.6613 | 0.1579 | 40.213 | −0.3129 | 0.2331 | 41.4 |
| −1.4392 | 0.5352 | 40.213 | −0.2371 | 0.1983 | 41.4 |
| −0.9176 | 0.8859 | 40.213 | −0.5478 | 0.9912 | 41.4 |
| −0.5872 | 0.1774 | 40.213 | −0.0903 | 0.1193 | 41.4 |
| −1.1964 | 0.7378 | 40.213 | −1.5727 | 0.4498 | 41.4 |
| −0.1837 | 0.0569 | 40.213 | −0.6497 | 0.9968 | 41.4 |
| −1.6585 | 0.2049 | 40.213 | −1.2234 | 0.8101 | 41.4 |
| −0.7135 | 0.9382 | 40.213 | −0.3483 | 0.9493 | 41.4 |
| −1.2812 | 0.6749 | 40.213 | −1.5211 | 0.533 | 41.4 |
| −1.6247 | 0.2939 | 40.213 | −1.2083 | 0.3012 | 41.4 |
| −1.0078 | 0.1859 | 40.213 | −0.6309 | 0.3313 | 41.4 |
| −0.7554 | 0.1953 | 40.213 | −0.1592 | 0.8728 | 41.4 |
| −0.9238 | 0.1939 | 40.213 | −1.3056 | 0.7495 | 41.4 |
| −1.6484 | 0.1129 | 40.213 | 0.0171 | 0.7701 | 41.4 |
| −1.4562 | 0.0703 | 40.213 | −1.2872 | 0.2744 | 41.4 |
| −0.2619 | 0.0888 | 40.213 | −1.0457 | 0.3381 | 41.4 |
| −1.4974 | 0.0637 | 40.213 | −1.6038 | 0.3085 | 41.4 |
| −1.2556 | 0.1344 | 40.213 | −0.0193 | 0.0756 | 41.4 |
| −1.3821 | 0.6072 | 40.213 | −1.5488 | 0.4925 | 41.4 |
| −0.6708 | 0.1888 | 40.213 | −0.8797 | 0.3525 | 41.4 |
| −0.8169 | 0.9174 | 40.213 | −1.6039 | 0.3573 | 41.4 |
| −1.5392 | 0.0624 | 40.213 | −0.7964 | 0.351 | 41.4 |
| 0.0809 | 0.7183 | 40.213 | −0.4692 | 0.291 | 41.4 |
| −0.5042 | 0.1616 | 40.213 | −0.963 | 0.3483 | 41.4 |
| −1.5762 | 0.3751 | 40.213 | −0.8524 | 0.9748 | 41.4 |
| −0.0317 | −0.0166 | 40.213 | −0.7517 | 0.9914 | 41.4 |
| −0.8394 | 0.197 | 40.213 | −1.592 | 0.4048 | 41.4 |
| −1.0146 | 0.8445 | 40.213 | 0.1004 | 0.711 | 41.4 |
| −1.1076 | 0.7948 | 40.213 | −1.3659 | 0.2469 | 41.4 |
| −0.3988 | 0.9296 | 40.213 | −1.4396 | 0.2316 | 41.4 |
| −1.336 | 0.1086 | 40.213 | −0.5494 | 0.3136 | 41.4 |
| −0.1967 | 0.8691 | 40.213 | 0.0501 | 0.0294 | 41.4 |
| −1.6018 | 0.3353 | 40.213 | 0.258 | 0.5812 | 41.4 |
| −0.6085 | 0.9472 | 40.213 | −0.1629 | 0.1603 | 41.4 |
| −1.174 | 0.1559 | 40.213 | 0.3326 | 0.5115 | 41.4 |
| −0.0081 | 0.7749 | 40.213 | −1.0457 | 0.9103 | 41.4 |
| −0.5031 | 0.9442 | 40.213 | 0.1807 | 0.6479 | 41.4 |
| −0.3415 | 0.117 | 40.213 | −0.3902 | 0.2641 | 41.4 |
| 0.1684 | 0.6585 | 40.213 | −1.1276 | 0.3224 | 41.4 |
| −1.6437 | 0.2505 | 40.213 | −0.2522 | 0.9148 | 41.4 |
| −1.5806 | 0.0676 | 40.213 | −0.0694 | 0.8242 | 41.4 |
| 0.328 | 0.5208 | 40.213 | −1.5147 | 0.2329 | 41.4 |
| −0.2962 | 0.9042 | 40.213 | −1.4772 | 0.2296 | 41.4 |
| −1.5117 | 0.4585 | 40.213 | −1.3832 | 0.6832 | 41.4 |
| −0.1069 | 0.0218 | 40.213 | −1.5506 | 0.2441 | 41.4 |
| 0.6185 | 0.215 | 40.213 | −0.9507 | 0.9475 | 41.4 |
| 1.8176 | −1.7672 | 40.213 | 1.4833 | −1.5812 | 41.4 |
| 0.2543 | 0.1957 | 40.213 | 0.9639 | −0.2882 | 41.4 |
| 1.3994 | −1.4268 | 40.213 | 0.2496 | −0.1214 | 41.4 |
| 0.4043 | 0.448 | 40.213 | 1.5292 | −1.6508 | 41.4 |
| 0.4538 | 0.3517 | 40.213 | 1.2462 | −1.2383 | 41.4 |
| 0.9321 | 0.8278 | 40.213 | 0.8906 | −0.7756 | 41.4 |
| 0.9872 | −0.8917 | 40.213 | 1.4369 | −1.5119 | 41.4 |
| 0.8755 | −0.1196 | 40.213 | 1.4189 | −1.0863 | 41.4 |
| 1.4957 | −1.5654 | 40.213 | 0.4047 | 0.4391 | 41.4 |
| 1.4703 | −1.1153 | 40.213 | 0.5418 | 0.2879 | 41.4 |
| 1.2686 | −0.7446 | 40.213 | 0.7827 | −0.6484 | 41.4 |
| 1.8161 | −1.8444 | 40.213 | 1.7327 | −1.7285 | 41.4 |
| 1.5429 | −1.6354 | 40.213 | 1.5566 | −1.3599 | 41.4 |
| 1.6191 | −1.3946 | 40.213 | 1.3717 | −0.9957 | 41.4 |
| 0.9356 | −0.2063 | 40.213 | 1.2752 | −0.8157 | 41.4 |
| 1.8269 | −1.806 | 40.213 | 0.6707 | 0.1295 | 41.4 |
| 0.7505 | 0.0505 | 40.213 | 0.851 | −0.1181 | 41.4 |
| 1.7879 | −1.8727 | 40.213 | 1.1242 | −0.5493 | 41.4 |
| 0.5494 | 0.2949 | 40.213 | 0.118 | −0.019 | 41.4 |
| 0.7609 | −0.6411 | 40.213 | 1.6436 | −1.8123 | 41.4 |
| 1.0949 | −1.0218 | 40.213 | 1.1478 | −1.1037 | 41.4 |
| 0.0421 | −0.0576 | 40.213 | 1.6014 | −1.4517 | 41.4 |
| 1.2504 | −1.2218 | 40.213 | 1.5112 | −1.2684 | 41.4 |
| 1.1075 | −0.472 | 40.213 | 1.7287 | −1.7901 | 41.4 |
| 0.8138 | −0.0339 | 40.213 | 0.6142 | −0.4835 | 41.4 |

TABLE I-continued

| | | | | | |
|---|---|---|---|---|---|
| 1.4207 | −1.0221 | 40.213 | 1.0469 | −0.9709 | 41.4 |
| 1.6812 | −1.8477 | 40.213 | 1.6892 | −1.636 | 41.4 |
| 0.4781 | −0.3726 | 40.213 | 0.9081 | −0.2027 | 41.4 |
| 0.3222 | −0.2459 | 40.213 | 0.3133 | −0.1752 | 41.4 |
| 1.5695 | −1.3016 | 40.213 | 0.9434 | −0.8401 | 41.4 |
| 1.6353 | −1.7767 | 40.213 | 1.7386 | −1.7598 | 41.4 |
| 0.819 | −0.7024 | 40.213 | 0.7924 | −0.0345 | 41.4 |
| 1.5894 | −1.7059 | 40.213 | 0.4973 | −0.3447 | 41.4 |
| 1.0514 | −0.3827 | 40.213 | 1.6455 | −1.5438 | 41.4 |
| 0.1143 | −0.1013 | 40.213 | 1.7054 | −1.8119 | 41.4 |
| 0.1851 | −0.1474 | 40.213 | 1.6202 | −1.7906 | 41.4 |
| 0.6416 | −0.5216 | 40.213 | 1.0718 | −0.4616 | 41.4 |
| 0.9942 | −0.2941 | 40.213 | 0.3758 | −0.2305 | 41.4 |
| 1.7107 | −1.8746 | 40.213 | 0.7274 | −0.586 | 41.4 |
| 1.3708 | −0.9291 | 40.213 | 0.5563 | −0.4036 | 41.4 |
| 1.3202 | −0.8366 | 40.213 | 1.3899 | −1.443 | 41.4 |
| 0.876 | −0.7646 | 40.213 | 0.7323 | 0.0481 | 41.4 |
| 1.0415 | −0.9564 | 40.213 | 0.6072 | 0.2095 | 41.4 |
| 1.4478 | −1.4958 | 40.213 | 1.1973 | −1.1708 | 41.4 |
| 1.7495 | −1.8837 | 40.213 | 1.3239 | −0.9055 | 41.4 |
| 1.3006 | −1.2896 | 40.213 | 1.0184 | −0.3745 | 41.4 |
| 1.7183 | −1.5809 | 40.213 | 1.6745 | −1.82 | 41.4 |
| 1.1475 | −1.0879 | 40.213 | 1.2947 | −1.3061 | 41.4 |
| 0.3887 | −0.298 | 40.213 | 0.837 | −0.7117 | 41.4 |
| 0.5802 | −0.4636 | 40.213 | 0.4371 | −0.2869 | 41.4 |
| 0.7018 | −0.5808 | 40.213 | 0.1845 | −0.0694 | 41.4 |
| 1.2159 | −0.6531 | 40.213 | 0.9955 | −0.9052 | 41.4 |
| 1.1622 | −0.5622 | 40.213 | 1.5747 | −1.7207 | 41.4 |
| 1.5198 | −1.2084 | 40.213 | 0.6713 | −0.5244 | 41.4 |
| 0.5177 | −0.407 | 40.213 | 1.3426 | −1.3744 | 41.4 |
| 1.1993 | −1.1546 | 40.213 | 0.4743 | 0.3645 | 41.4 |
| 1.3504 | −1.3578 | 40.213 | 1.1754 | −0.6376 | 41.4 |
| 0.6855 | 0.1335 | 40.213 | 1.0977 | −1.037 | 41.4 |
| 1.768 | −1.6741 | 40.213 | 1.2258 | −0.7264 | 41.4 |
| 1.6687 | −1.4876 | 40.213 | 1.4654 | −1.1772 | 41.4 |

| X(30%) | Y(30%) | Z(30%) | X(40%) | Y(40%) | Z(40%) |
|---|---|---|---|---|---|
| 1.0013 | 0.4872 | 42.597 | −1.0081 | 1.107 | 43.784 |
| −0.6898 | 1.071 | 42.597 | −1.2735 | 0.5551 | 43.784 |
| −0.7887 | 1.0678 | 42.597 | −0.6281 | 1.1421 | 43.784 |
| −1.0826 | 0.4754 | 42.597 | −1.4061 | 0.8458 | 43.784 |
| −1.3992 | 0.7693 | 42.597 | −1.4354 | 0.5865 | 43.784 |
| −0.8867 | 1.0537 | 42.597 | −1.3061 | 0.5503 | 43.784 |
| −1.3254 | 0.8353 | 42.597 | −1.0378 | 0.6098 | 43.784 |
| −1.2467 | 0.8953 | 42.597 | −1.4905 | 0.6248 | 43.784 |
| −0.9824 | 1.0286 | 42.597 | −0.9152 | 1.1323 | 43.784 |
| −1.4653 | 0.6958 | 42.597 | −1.484 | 0.7212 | 43.784 |
| −1.0748 | 0.9931 | 42.597 | −1.4045 | 0.5555 | 43.784 |
| −1.1631 | 0.9483 | 42.597 | −1.4629 | 0.5846 | 43.784 |
| −0.3056 | 0.9849 | 42.597 | −1.1951 | 0.5743 | 43.784 |
| 0.4936 | 1.046 | 42.597 | −1.4369 | 0.8074 | 43.784 |
| 0.0356 | 0.7857 | 42.597 | −1.372 | 0.5502 | 43.784 |
| −0.2186 | 0.2908 | 42.597 | −1.339 | 0.5486 | 43.784 |
| −0.9194 | 0.4926 | 42.597 | −1.4635 | 0.766 | 43.784 |
| −0.2904 | 0.3305 | 42.597 | −1.0974 | 1.0715 | 43.784 |
| −0.4392 | 0.3996 | 42.597 | −0.8766 | 0.6173 | 43.784 |
| −0.7557 | 0.4842 | 42.597 | −1.495 | 0.6734 | 43.784 |
| −0.8374 | 0.4915 | 42.597 | −1.338 | 0.9138 | 43.784 |
| −0.0799 | 0.2029 | 42.597 | −0.8201 | 1.1465 | 43.784 |
| 0.3987 | 0.4503 | 42.597 | −1.1824 | 1.0265 | 43.784 |
| −0.364 | 0.3669 | 42.597 | −0.724 | 1.1497 | 43.784 |
| −0.1289 | 0.8956 | 42.597 | −0.9574 | 0.617 | 43.784 |
| 0.1885 | 0.86 | 42.597 | −1.1173 | 0.5958 | 43.784 |
| 0.0524 | 0.1057 | 42.597 | −1.2627 | 0.9736 | 43.784 |
| −0.6747 | 0.4709 | 42.597 | −0.3511 | 1.064 | 43.784 |
| −0.5162 | 0.4282 | 42.597 | −0.264 | 1.023 | 43.784 |
| −0.0452 | 0.8431 | 42.597 | 0.3943 | 0.4085 | 43.784 |
| 0.1164 | 0.0543 | 42.597 | −0.638 | 0.5788 | 43.784 |
| 0.1134 | 0.7246 | 42.597 | 0.2652 | 0.6112 | 43.784 |
| −0.2157 | 0.9434 | 42.597 | −0.561 | 0.5544 | 43.784 |
| −0.3984 | 1.0195 | 42.597 | −0.1365 | 0.324 | 43.784 |
| −0.1484 | 0.2482 | 42.597 | −0.4122 | 0.4916 | 43.784 |
| −0.5912 | 1.0635 | 42.597 | −0.7165 | 0.5977 | 43.784 |
| 0.3309 | 0.5226 | 42.597 | 0.1135 | 0.1197 | 43.784 |
| −0.5947 | 0.4521 | 42.597 | −0.5335 | 1.1246 | 43.784 |
| −0.013 | 0.1553 | 42.597 | 0.4559 | 0.3945 | 43.784 |
| 0.2609 | 0.5926 | 42.597 | 0.2306 | 0.0085 | 43.784 |
| 0.5851 | −0.4048 | 42.597 | −0.4857 | 0.5251 | 43.784 |

TABLE I-continued

| | | | | | |
|---|---|---|---|---|---|
| 1.0307 | −0.4344 | 42.597 | −0.0718 | 0.2757 | 43.784 |
| 0.7972 | −0.6556 | 42.597 | −0.3406 | 0.4543 | 43.784 |
| 0.4642 | 0.3762 | 42.597 | −0.2028 | 0.3701 | 43.784 |
| 0.5279 | 0.3003 | 42.597 | 0.1974 | 0.6795 | 43.784 |
| 0.9278 | −0.2652 | 42.597 | −0.0208 | 0.8683 | 43.784 |
| 0.8484 | −0.7197 | 42.597 | −0.441 | 1.0982 | 43.784 |
| 0.3594 | −0.1664 | 42.597 | −0.099 | 0.9244 | 43.784 |
| 0.4742 | −0.2838 | 42.597 | 0.1727 | 0.0647 | 43.784 |
| 0.6392 | −0.4666 | 42.597 | −0.0086 | 0.2254 | 43.784 |
| 0.3004 | −0.1093 | 42.597 | −0.1801 | 0.9762 | 43.784 |
| 0.5897 | 0.2229 | 42.597 | 0.0531 | 0.1733 | 43.784 |
| 0.179 | 0.0012 | 42.597 | 0.0546 | 0.8084 | 43.784 |
| 0.5301 | 0.3439 | 42.597 | −0.7961 | 0.6107 | 43.784 |
| 0.765 | −0.0168 | 42.597 | 0.3308 | 0.5408 | 43.784 |
| 0.9798 | −0.3496 | 42.597 | −0.2708 | 0.4136 | 43.784 |
| 0.8747 | −0.1816 | 42.597 | 0.1273 | 0.7454 | 43.784 |
| 0.7081 | 0.0642 | 42.597 | 0.943 | −0.3205 | 43.784 |
| 0.8208 | 0.0987 | 42.597 | 0.5576 | −0.349 | 43.784 |
| 0.7452 | −0.5919 | 42.597 | 0.8089 | −0.6851 | 43.784 |
| 0.6927 | −0.5289 | 42.597 | 0.2875 | −0.049 | 43.784 |
| 0.2403 | −0.0534 | 42.597 | 0.9054 | −0.7947 | 43.784 |
| 0.4172 | −0.2247 | 42.597 | 0.5053 | −0.2874 | 43.784 |
| 0.6497 | 0.1442 | 42.597 | 0.8574 | −0.7297 | 43.784 |
| 1.3833 | −1.0423 | 42.597 | 0.6304 | 0.1647 | 43.784 |
| 1.0808 | −0.52 | 42.597 | 0.5157 | 0.3192 | 43.784 |
| 1.2252 | −0.7794 | 42.597 | 0.5739 | 0.2425 | 43.784 |
| 0.949 | −0.6495 | 42.597 | 0.7103 | −0.5371 | 43.784 |
| 1.1777 | −0.6925 | 42.597 | 0.9915 | −0.4036 | 43.784 |
| 1.4082 | −1.1308 | 42.597 | 0.4522 | −0.2266 | 43.784 |
| 0.9984 | −0.915 | 42.597 | 0.8937 | −0.2379 | 43.784 |
| 1.2719 | −0.8667 | 42.597 | 0.66 | −0.4739 | 43.784 |
| 0.899 | −0.7843 | 42.597 | 0.8434 | −0.1559 | 43.784 |
| 1.1296 | −0.606 | 42.597 | 0.7599 | −0.6009 | 43.784 |
| 1.3179 | −0.9543 | 42.597 | 0.3982 | −1.665 | 43.784 |
| −1.3517 | 0.4021 | 42.597 | 0.7919 | −0.0745 | 43.784 |
| −1.5514 | 0.5122 | 42.597 | 1.039 | −0.4873 | 43.784 |
| −1.5115 | 0.4229 | 42.597 | 0.3434 | −0.1073 | 43.784 |
| −1.5215 | 0.6098 | 42.597 | 0.6856 | 0.0859 | 43.784 |
| −1.3845 | 0.3981 | 42.597 | 0.7394 | 0.0061 | 43.784 |
| −1.544 | 0.4618 | 42.597 | 0.6092 | −0.4112 | 43.784 |
| −1.4822 | 0.4078 | 42.597 | 1.6024 | −1.6639 | 43.784 |
| −1.1627 | 0.4575 | 42.597 | 1.1319 | −0.6559 | 43.784 |
| −1.4174 | 0.3972 | 42.597 | 1.3625 | −1.4604 | 43.784 |
| −1.4503 | 0.3998 | 42.597 | 1.0464 | −0.9916 | 43.784 |
| −1.241 | 0.4329 | 42.597 | 0.9999 | −0.9257 | 43.784 |
| −1.4955 | 0.6541 | 42.597 | 1.3534 | −1.0829 | 43.784 |
| −1.5412 | 0.5624 | 42.597 | 1.0926 | −1.0579 | 43.784 |
| −1.3195 | 0.4089 | 42.597 | 1.2289 | −1.2582 | 43.784 |
| 1.3763 | −1.4521 | 42.597 | 1.1774 | −0.7407 | 43.784 |
| 1.5401 | −1.3967 | 42.597 | 1.1839 | −1.1912 | 43.784 |
| 1.0957 | −1.0473 | 42.597 | 1.0859 | −0.5714 | 43.784 |
| 1.1909 | −1.1811 | 42.597 | 1.2221 | −0.8259 | 43.784 |
| 1.5114 | −1.658 | 42.597 | 1.579 | −1.688 | 43.784 |
| 1.6414 | −1.7484 | 42.597 | 1.3962 | −1.1691 | 43.784 |
| 1.4526 | −1.2191 | 42.597 | 1.2738 | −1.3254 | 43.784 |
| 1.4217 | −1.5205 | 42.597 | 0.9529 | −0.86 | 43.784 |
| 1.6685 | −1.6646 | 42.597 | 1.31 | −0.997 | 43.784 |
| 1.4966 | −1.3078 | 42.597 | 1.517 | −1.6861 | 43.784 |
| 1.2844 | −1.3161 | 42.597 | 1.2664 | −0.9113 | 43.784 |
| 1.6647 | −1.7285 | 42.597 | 1.548 | −1.694 | 43.784 |
| 1.1435 | −1.1141 | 42.597 | 1.4064 | −1.5282 | 43.784 |
| 1.2378 | −1.2484 | 42.597 | 1.45 | −1.5962 | 43.784 |
| 1.5832 | −1.4859 | 42.597 | 1.6061 | −1.602 | 43.784 |
| 1.3306 | −1.3839 | 42.597 | 1.4809 | −1.3419 | 43.784 |
| 1.4667 | −1.5892 | 42.597 | 1.6122 | −1.6335 | 43.784 |
| 1.6258 | −1.5753 | 42.597 | 1.4388 | −1.2554 | 43.784 |
| 1.556 | −1.7269 | 42.597 | 1.5645 | −1.5153 | 43.784 |
| 1.6105 | −1.7565 | 42.597 | 1.5229 | −1.4285 | 43.784 |
| 1.5795 | −1.7487 | 42.597 | 1.4936 | −1.6642 | 43.784 |
| 1.6745 | −1.696 | 42.597 | 1.3183 | −1.3928 | 43.784 |
| 1.0472 | −0.981 | 42.597 | 1.1384 | −1.1244 | 43.784 |

| X(50%) | Y(50%) | Z(50%) | X(60%) | Y(60%) | Z(60%) |
|---|---|---|---|---|---|
| −1.3858 | 0.7184 | 44.971 | −0.9511 | 0.8607 | 46.169 |
| −0.6795 | 0.7035 | 44.971 | −1.336 | 0.8755 | 46.169 |
| −1.4254 | 0.873 | 44.971 | −0.7951 | 0.8471 | 46.169 |
| −0.9148 | 0.7384 | 44.971 | −1.3642 | 1.0304 | 46.169 |
| −0.4764 | 1.1821 | 44.971 | −0.7188 | 0.8294 | 46.169 |

TABLE I-continued

| | | | | | |
|---|---|---|---|---|---|
| −0.9942 | 0.7357 | 44.971 | −1.3586 | 0.8979 | 46.169 |
| −1.073 | 0.7258 | 44.971 | −1.3111 | 1.1064 | 46.169 |
| −1.2732 | 1.0513 | 44.971 | −0.4192 | 1.2364 | 46.169 |
| −0.6585 | 1.2239 | 44.971 | −0.6441 | 0.8056 | 46.169 |
| −0.7518 | 1.2304 | 44.971 | −1.2165 | 0.8362 | 46.169 |
| −1.2933 | 0.6928 | 44.971 | −0.9529 | 1.2977 | 46.169 |
| −0.9376 | 1.2109 | 44.971 | −0.8728 | 0.8577 | 46.169 |
| −1.1138 | 1.1487 | 44.971 | −0.7722 | 1.3172 | 46.169 |
| −1.1504 | 0.7078 | 44.971 | −1.2774 | 1.1385 | 46.169 |
| −1.0274 | 1.1848 | 44.971 | −1.0294 | 0.8559 | 46.169 |
| −1.1957 | 1.1039 | 44.971 | −1.3406 | 1.0705 | 46.169 |
| −1.3758 | 0.9544 | 44.971 | −1.3779 | 0.986 | 46.169 |
| −1.3566 | 0.7049 | 44.971 | −1.1066 | 0.8428 | 46.169 |
| −1.4375 | 0.8269 | 44.971 | −0.6813 | 1.3109 | 46.169 |
| −1.2609 | 0.6917 | 44.971 | −1.2791 | 0.8476 | 46.169 |
| −0.8453 | 1.2281 | 44.971 | −1.3089 | 0.859 | 46.169 |
| −1.2287 | 0.6939 | 44.971 | −0.5917 | 1.2946 | 46.169 |
| −0.7568 | 0.7218 | 44.971 | −0.3372 | 1.1967 | 46.169 |
| −0.8354 | 0.7336 | 44.971 | −0.5041 | 1.2695 | 46.169 |
| −1.3438 | 0.9899 | 44.971 | −1.1846 | 0.8354 | 46.169 |
| −1.4037 | 0.9155 | 44.971 | −1.3781 | 0.9398 | 46.169 |
| −1.3252 | 0.8988 | 44.971 | −1.2039 | 1.1922 | 46.169 |
| −1.4349 | 0.7794 | 44.971 | −1.1241 | 1.2363 | 46.169 |
| −1.4111 | 0.7385 | 44.971 | −1.2481 | 0.8402 | 46.169 |
| −0.5664 | 1.2075 | 44.971 | −0.5714 | 0.7762 | 46.169 |
| −0.0057 | 0.2949 | 44.971 | −0.8631 | 1.313 | 46.169 |
| 0.2207 | 0.0716 | 44.971 | −1.0403 | 1.2719 | 46.169 |
| 0.2707 | 0.6357 | 44.971 | −0.1778 | 0.5215 | 46.169 |
| 0.2228 | 1.0629 | 44.971 | 0.1054 | 0.2507 | 46.169 |
| 0.3319 | 0.5649 | 44.971 | −0.1823 | 1.1009 | 46.169 |
| −0.4579 | 0.6164 | 44.971 | −0.5009 | 0.7422 | 46.169 |
| −0.1443 | 1.0119 | 44.971 | 0.2105 | 0.1343 | 46.169 |
| 0.3913 | 0.4926 | 44.971 | −0.039 | 0.9884 | 46.169 |
| 0.1657 | 0.1291 | 44.971 | −0.3014 | 0.6179 | 46.169 |
| 0.0042 | 0.8981 | 44.971 | 0.0938 | 0.8635 | 46.169 |
| −0.6038 | 0.6794 | 44.971 | −0.1093 | 1.0464 | 46.169 |
| −0.5298 | 0.6501 | 44.971 | 0.3335 | 0.5892 | 46.169 |
| −0.1266 | 0.398 | 44.971 | 0.3614 | −0.0461 | 46.169 |
| −0.389 | 1.1489 | 44.971 | −0.3859 | 0.6624 | 46.169 |
| −0.2537 | 0.4934 | 44.971 | 0.3889 | 0.5168 | 46.169 |
| −0.3044 | 1.1088 | 44.971 | 0.5484 | 0.2934 | 46.169 |
| 0.0743 | 0.8362 | 44.971 | −0.0605 | 0.4174 | 46.169 |
| −0.1893 | 0.4469 | 44.971 | 0.1584 | 0.193 | 46.169 |
| 0.3274 | 0.0481 | 44.971 | 0.0512 | 0.3074 | 46.169 |
| 0.1098 | 0.1858 | 44.971 | 0.1567 | 0.7978 | 46.169 |
| −0.3199 | 0.5375 | 44.971 | 0.2764 | 0.6602 | 46.169 |
| 0.505 | 0.344 | 44.971 | 0.0286 | 0.9273 | 46.169 |
| 0.0687 | 0.9589 | 44.971 | −0.2582 | 1.1513 | 46.169 |
| 0.2075 | 0.7047 | 44.971 | 0.4952 | 0.3688 | 46.169 |
| 0.2745 | 0.0134 | 44.971 | 0.2615 | 0.0749 | 46.169 |
| 0.1421 | 0.7718 | 44.971 | −0.4324 | 0.704 | 46.169 |
| −0.3879 | 0.5788 | 44.971 | −0.004 | 0.363 | 46.169 |
| 0.0527 | 0.2499 | 44.971 | −0.1184 | 0.4704 | 46.169 |
| −0.0654 | 0.3473 | 44.971 | 0.2175 | 0.7298 | 46.169 |
| 0.6287 | −0.4159 | 44.971 | 0.3119 | 0.0147 | 46.169 |
| 0.8136 | 0.1251 | 44.971 | −0.2387 | 0.5708 | 46.169 |
| 1.0437 | −0.5324 | 44.971 | 0.997 | −0.9405 | 46.169 |
| 0.9992 | −0.4501 | 44.971 | 0.5526 | −0.2946 | 46.169 |
| 0.954 | 0.3581 | 44.971 | 0.9619 | −0.4134 | 46.169 |
| 0.8612 | −0.2055 | 44.971 | 0.5057 | −0.2318 | 46.169 |
| 0.531 | −0.2904 | 44.971 | 0.911 | −0.8094 | 46.169 |
| 1.0877 | 0.615 | 44.971 | 1.0396 | −1.0062 | 46.169 |
| 0.5596 | 0.2679 | 44.971 | 0.9541 | −0.8748 | 46.169 |
| 0.3795 | −0.1062 | 44.971 | 0.8237 | −0.679 | 46.169 |
| 0.8173 | −0.6718 | 44.971 | 0.7857 | −0.0943 | 46.169 |
| 0.4812 | −0.2284 | 44.971 | 0.8752 | −0.2531 | 46.169 |
| 0.6766 | −0.4793 | 44.971 | 1.0463 | −0.575 | 46.169 |
| 0.9089 | −0.8018 | 44.971 | 0.7398 | −0.0156 | 46.169 |
| 0.724 | −0.5431 | 44.971 | 1.0878 | −0.6561 | 46.169 |
| 0.765 | −0.045 | 44.971 | 0.599 | −0.3579 | 46.169 |
| 0.7153 | 0.0343 | 44.971 | 0.8675 | −0.7441 | 46.169 |
| 0.6127 | 0.1909 | 44.971 | 0.6451 | 0.1402 | 46.169 |
| 0.4307 | 0.1671 | 44.971 | 0.8308 | −0.1735 | 46.169 |
| 0.9541 | −0.8672 | 44.971 | 0.6448 | −0.4215 | 46.169 |
| 0.5802 | −0.3529 | 44.971 | 1.1288 | −0.7375 | 46.169 |
| 0.7709 | −0.6073 | 44.971 | 1.0044 | −0.494 | 46.169 |
| 0.908 | −0.2866 | 44.971 | 0.7795 | −0.6142 | 46.169 |
| 0.8833 | −0.7366 | 44.971 | 0.9189 | −0.333 | 46.169 |
| 0.6647 | 0.1129 | 44.971 | 0.5964 | 0.2171 | 46.169 |

TABLE I-continued

| | | | | | |
|---|---|---|---|---|---|
| 1.1311 | −0.698 | 44.971 | 0.735 | −0.5497 | 46.169 |
| 1.2163 | −0.8645 | 44.971 | 0.693 | 0.0626 | 46.169 |
| 1.3898 | −1.532 | 44.971 | 0.4582 | −0.1694 | 46.169 |
| 1.2185 | −1.2641 | 44.971 | 0.6901 | −0.4855 | 46.169 |
| 1.3 | −1.032 | 44.971 | 0.4101 | −0.1075 | 46.169 |
| 1.3412 | −1.116 | 44.971 | 1.1695 | −0.819 | 46.169 |
| 1.1315 | −1.131 | 44.971 | 1.3686 | −1.2289 | 46.169 |
| 1.0434 | −0.9987 | 44.971 | 1.2496 | −1.3372 | 46.169 |
| 1.4232 | −1.2843 | 44.971 | 1.3738 | −1.537 | 46.169 |
| 1.5177 | −1.6215 | 44.971 | 1.428 | −1.5676 | 46.169 |
| 1.2617 | −1.3309 | 44.971 | 1.082 | −1.0722 | 46.169 |
| 1.5412 | −1.5995 | 44.971 | 1.3291 | −1.1468 | 46.169 |
| 1.4887 | −1.6295 | 44.971 | 1.2498 | −0.9827 | 46.169 |
| 1.5043 | −1.453 | 44.971 | 1.1662 | −1.2045 | 46.169 |
| 1.2583 | −0.9482 | 44.971 | 1.2895 | −1.0647 | 46.169 |
| 1.1752 | 1.1975 | 44.971 | 1.1242 | −1.1383 | 46.169 |
| X(50%) | Y(50%) | Z(50%) | 1.4865 | −1.4756 | 46.169 |
| 0.9989 | 0.9328 | 44.971 | 1.4472 | −1.3934 | 46.169 |
| 1.3823 | −1.2001 | 44.971 | 1.208 | −1.2708 | 46.169 |
| 1.5448 | −1.5374 | 44.971 | 1.2098 | −0.9008 | 46.169 |
| 1.3473 | −1.4649 | 44.971 | 1.4828 | −1.5378 | 46.169 |
| 1.5509 | −1.569 | 44.971 | 1.4926 | −1.5072 | 46.169 |
| 1.4638 | −1.3688 | 44.971 | 1.408 | −1.3111 | 46.169 |
| 1.4323 | −1.5993 | 44.971 | 1.4593 | −1.5598 | 46.169 |
| 1.0876 | −1.0648 | 44.971 | 1.397 | −1.5593 | 46.169 |
| 1.3046 | −1.3978 | 44.971 | 1.2911 | −1.4038 | 46.169 |
| 1.4556 | −1.6214 | 44.971 | 1.3325 | −1.4704 | 46.169 |

| X(70%) | Y(70%) | Z(70%) | X(80%) | Y(80%) | Z(80%) | X(90%) | Y(90%) | Z(90%) |
|---|---|---|---|---|---|---|---|---|
| −1.0477 | 1.372 | 47.357 | −1.1832 | 1.1642 | 48.544 | −0.952 | 1.6067 | 49.742 |
| −0.7661 | 1.4144 | 47.357 | −1.1652 | 1.4146 | 48.544 | −0.7837 | 1.6154 | 49.742 |
| 1.3185 | 1.0956 | 47.357 | −0.7164 | 1.0663 | 48.544 | −1.1727 | 1.4036 | 49.742 |
| 0.4749 | 0.834 | 47.357 | −0.5352 | 1.4585 | 48.544 | −0.4872 | 1.0457 | 49.742 |
| 1.2762 | 1.2281 | 47.357 | −1.2311 | 1.3393 | 48.544 | −0.6185 | 1.5814 | 49.742 |
| 0.6831 | 0.9369 | 47.357 | −0.3267 | 0.8249 | 48.544 | −0.3118 | 0.8998 | 49.742 |
| 0.5258 | 1.3628 | 47.357 | −0.8643 | 1.1068 | 48.544 | −0.8238 | 1.2185 | 49.742 |
| 0.2887 | 1.2419 | 47.357 | −0.4562 | 1.4208 | 48.544 | −0.1924 | 1.3136 | 49.742 |
| 0.9625 | 1.3969 | 47.357 | −1.0433 | 1.4764 | 48.544 | −1.078 | 1.5637 | 49.742 |
| 0.6115 | 0.9073 | 47.357 | −0.3863 | 0.8734 | 48.544 | −0.0725 | 1.1944 | 49.742 |
| 0.6105 | 1.3892 | 47.357 | −1.0173 | 1.1166 | 48.544 | −0.6146 | 1.1287 | 49.742 |
| 1.2435 | 1.2629 | 47.357 | −1.2194 | 1.197 | 48.544 | −1.0336 | 1.5848 | 49.742 |
| 0.5421 | 0.8728 | 47.357 | −0.1713 | 1.225 | 48.544 | −1.1691 | 1.4524 | 49.742 |
| 1.3189 | 1.1429 | 47.357 | −1.2024 | 1.3805 | 48.544 | −1.1499 | 1.4976 | 49.742 |
| 1.296 | 1.0529 | 47.357 | −0.7894 | 1.09 | 48.544 | −0.2569 | 0.8472 | 49.742 |
| 0.7569 | 0.9608 | 47.357 | −1.2024 | 1.1793 | 48.544 | −0.7517 | 1.1943 | 49.742 |
| 1.1704 | 0.9564 | 47.357 | −0.7876 | 1.5135 | 48.544 | −1.1572 | 1.3571 | 49.742 |
| 1.1417 | 0.9825 | 47.357 | −0.6458 | 1.0364 | 48.544 | −1.1097 | 1.3022 | 49.742 |
| 0.4437 | 1.3287 | 47.357 | −0.6171 | 1.4847 | 48.544 | −0.2559 | 1.3693 | 49.742 |
| 1.276 | 1.0319 | 47.357 | −0.3078 | 1.3317 | 48.544 | −0.4268 | 0.9994 | 49.742 |
| 1.2281 | 1.0025 | 47.357 | −0.9599 | 1.4994 | 48.544 | −1.0898 | 1.2881 | 49.742 |
| 1.1987 | 0.9931 | 47.357 | −1.1622 | 1.1515 | 48.544 | −0.5397 | 1.551 | 49.742 |
| 0.9094 | 0.9874 | 47.357 | −1.117 | 1.1325 | 48.544 | −0.3683 | 0.9507 | 49.742 |
| 1.1296 | 1.3375 | 47.357 | −0.5114 | 0.9621 | 48.544 | −1.0687 | 1.2759 | 49.742 |
| 1.3023 | 1.1882 | 47.357 | −0.7015 | 1.5041 | 48.544 | −0.1313 | 1.2552 | 49.742 |
| 1.2522 | 1.0153 | 47.357 | −0.9405 | 1.1157 | 48.544 | −0.5497 | 1.089 | 49.742 |
| 0.6976 | 1.4068 | 47.357 | −0.8742 | 1.5121 | 48.544 | −0.8979 | 1.2357 | 49.742 |
| 0.8325 | 0.9779 | 47.357 | −0.4478 | 0.9192 | 48.544 | −0.3915 | 1.4899 | 49.742 |
| 1.0642 | 0.9821 | 47.357 | −1.1228 | 1.4419 | 48.544 | −1.1439 | 1.3367 | 49.742 |
| 1.2062 | 1.2927 | 47.357 | −0.5774 | 1.0013 | 48.544 | −0.7001 | 1.6033 | 49.742 |
| 0.9869 | 0.9889 | 47.357 | −1.2462 | 1.2913 | 48.544 | −0.6819 | 1.164 | 49.742 |
| 0.8748 | 1.4112 | 47.357 | −1.0934 | 1.1262 | 48.544 | −1.0485 | 1.2658 | 49.742 |
| 0.3647 | 1.288 | 47.357 | −1.243 | 1.2413 | 48.544 | −1.1279 | 1.3183 | 49.742 |
| 0.0784 | 1.0784 | 47.357 | −0.2381 | 1.2802 | 48.544 | −0.8681 | 1.6166 | 49.742 |
| 0.1458 | 1.1364 | 47.357 | −1.14 | 1.141 | 48.544 | −1.1178 | 1.5348 | 49.742 |
| 0.2238 | 0.7534 | 47.357 | −0.3805 | 1.3789 | 48.544 | −0.9733 | 1.2457 | 49.742 |
| 0.6243 | 0.1666 | 47.357 | 0.373 | 0.0127 | 48.544 | −0.464 | 1.5135 | 49.742 |
| 0.3469 | 0.7464 | 47.357 | 0.4168 | −0.0503 | 48.544 | −0.3223 | 1.4216 | 49.742 |
| 0.1128 | 0.5432 | 47.357 | −0.1582 | 0.668 | 48.544 | −0.2034 | 0.7931 | 49.742 |
| 0.5782 | 0.2427 | 47.357 | 0.6513 | 0.1169 | 48.544 | 0.0452 | 0.5053 | 49.742 |
| 0.2158 | 1.1912 | 47.357 | 0.5032 | −0.1772 | 48.544 | 0.5946 | 0.2206 | 49.742 |
| 0.2954 | 0.0767 | 47.357 | −0.1049 | 0.6128 | 48.544 | 0.2716 | 0.1997 | 49.742 |
| 0.3318 | 0.6123 | 47.357 | 0.3824 | 0.5618 | 48.544 | 0.7145 | 0.0028 | 49.742 |
| 0.434 | 0.4669 | 47.357 | −0.0529 | 0.5563 | 48.544 | 0.4254 | 0.5132 | 49.742 |
| 0.1989 | 0.1981 | 47.357 | 0.6088 | 0.1923 | 48.544 | 0.3999 | 0.0109 | 49.742 |
| 0.2766 | 0.6834 | 47.357 | 0.1813 | 0.8439 | 48.544 | 0.2421 | 0.7973 | 49.742 |

TABLE I-continued

| | | | | | | | | |
|---|---|---|---|---|---|---|---|---|
| 0.4099 | 0.7917 | 47.357 | 0.334 | 0.6337 | 48.544 | 0.5115 | 0.3678 | 49.742 |
| 0.2267 | 0.6488 | 47.357 | 0.1274 | 0.9118 | 48.544 | 0.6351 | 0.1464 | 49.742 |
| 0.0045 | 0.4322 | 47.357 | 0.4757 | 0.4157 | 48.544 | 0.3358 | 0.6566 | 49.742 |
| 0.1495 | 0.2529 | 47.357 | 0.1915 | 0.2604 | 48.544 | 0.0023 | 0.5847 | 49.742 |
| 0.0992 | 0.3169 | 47.357 | −0.2128 | 0.722 | 48.544 | 0.4688 | 0.4407 | 49.742 |
| 0.4832 | 0.3929 | 47.357 | −0.0453 | 1.106 | 48.544 | 0.1832 | 0.3235 | 49.742 |
| 0.0137 | 1.0176 | 47.357 | −0.0021 | 0.4987 | 48.544 | 0.092 | 1.0016 | 49.742 |
| 0.3425 | 0.0151 | 47.357 | −0.2689 | 0.7744 | 48.544 | 0.4832 | 0.1165 | 49.742 |
| 0.1674 | 0.822 | 47.357 | 0.2378 | 0.1992 | 48.544 | 0.2895 | 0.7273 | 49.742 |
| 0.389 | −0.047 | 47.357 | 0.2835 | 0.1374 | 48.544 | 0.0389 | 1.0673 | 49.742 |
| 0.3836 | 0.54 | 47.357 | −0.107 | 1.1668 | 48.544 | 0.4417 | −0.0527 | 49.742 |
| 0.4349 | −0.1095 | 47.357 | 0.0478 | 0.4403 | 48.544 | 0.3149 | 0.1371 | 49.742 |
| 0.2476 | 0.1377 | 47.357 | 0.4296 | 0.489 | 48.544 | 0.1934 | 0.8663 | 49.742 |
| 0.0488 | 0.9545 | 47.357 | 0.4602 | −0.1137 | 48.544 | 0.092 | 0.4453 | 49.742 |
| 0.1091 | 0.8891 | 47.357 | 0.0965 | 0.3809 | 48.544 | −0.0509 | 0.6233 | 49.742 |
| 0.5312 | 0.3181 | 47.357 | 0.5651 | 0.2673 | 48.544 | −0.1514 | 0.7376 | 49.742 |
| 0.169 | 0.5967 | 47.357 | 0.0717 | 0.9783 | 48.544 | 0.2276 | 0.2617 | 49.742 |
| 0.0478 | 0.375 | 47.357 | 0.5209 | 0.3416 | 48.544 | −0.1006 | 0.6809 | 49.742 |
| 0.2859 | 0.6988 | 47.357 | 0.0142 | 1.0431 | 48.544 | 0.5648 | −0.2448 | 49.742 |
| 0.0581 | 0.4884 | 47.357 | 0.2336 | 0.7749 | 48.544 | 0.1434 | 0.9345 | 49.742 |
| 0.9251 | −0.3778 | 47.357 | 0.3285 | 0.0753 | 48.544 | 0.6751 | 0.0719 | 49.742 |
| 0.7426 | −0.5566 | 47.357 | 0.2845 | 0.7048 | 48.544 | 0.5534 | 0.2943 | 49.742 |
| 0.8002 | −0.1422 | 47.357 | 0.1444 | 0.321 | 48.544 | 0.138 | 0.3847 | 49.742 |
| 0.864 | −0.299 | 47.357 | 0.9334 | −0.4201 | 48.544 | 0.3811 | 0.5852 | 49.742 |
| 0.6695 | 0.0901 | 47.357 | 0.5878 | −0.3054 | 48.544 | −0.0158 | 1.1317 | 49.742 |
| 0.7137 | 0.0131 | 47.357 | 1.0331 | −1.0228 | 48.544 | 0.5242 | −0.1806 | 49.742 |
| 0.6132 | −0.3632 | 47.357 | 0.6711 | −0.4344 | 48.544 | 0.3577 | 0.0742 | 49.742 |
| 0.8272 | −0.6866 | 47.357 | 1.112 | −1.1547 | 48.544 | 0.7639 | 0−.569 | 49.742 |
| 0.9932 | −0.9487 | 47.357 | 0.6933 | 0.0411 | 48.544 | 1.301 | −1.2208 | 49.742 |
| 0.9107 | −0.8174 | 47.357 | 1.0725 | −1.0887 | 48.544 | 1.1491 | −1.2251 | 49.742 |
| 0.6998 | −0.492 | 47.357 | 0.9936 | −0.9571 | 48.544 | 0.9784 | −0.5322 | 49.742 |
| 0.8424 | −0.2205 | 47.357 | 0.834 | −0.6947 | 48.544 | 0.9417 | −0.4562 | 49.742 |
| 1.0456 | −0.6158 | 47.357 | 0.753 | −0.5842 | 48.544 | 1.1589 | −0.9144 | 49.742 |
| 0.4803 | −0.1724 | 47.357 | 0.7121 | −0.4992 | 48.544 | 1.1873 | −1.2909 | 49.742 |
| 0.9657 | −0.4568 | 47.357 | 1.0853 | −0.7316 | 48.544 | 1.0727 | −1.0935 | 49.742 |
| 1.0342 | −1.0145 | 47.357 | 1.1226 | −0.8098 | 48.544 | 1.2303 | −1.0676 | 49.742 |
| 0.5251 | −0.2357 | 47.357 | 1.0477 | −0.6536 | 48.544 | 0.9962 | −0.962 | 49.742 |
| 1.0849 | −0.6953 | 47.357 | 0.8741 | −0.7602 | 48.544 | 0.803 | −0.6342 | 49.742 |
| 1.124 | −0.7751 | 47.357 | 0.9718 | −0.4977 | 48.544 | 1.266 | −1.442 | 49.742 |
| 0.7573 | −0.0644 | 47.357 | 1.01 | −0.5756 | 48.544 | 1.0345 | −1.0277 | 49.742 |
| 0.869 | −0.752 | 47.357 | 0.5457 | −0.2412 | 48.544 | 1.0149 | −0.6085 | 49.742 |
| 0.6567 | −0.4275 | 47.357 | 0.7936 | −0.6294 | 48.544 | 1.0871 | −0.7613 | 49.742 |
| 0.952 | −0.883 | 47.357 | 0.7346 | −0.0351 | 48.544 | 0.8419 | −0.6997 | 49.742 |
| 1.1628 | −0.855 | 47.357 | 0.8158 | −0.1883 | 48.544 | 0.6452 | −0.374 | 49.742 |
| 1.0058 | −0.5361 | 47.357 | 0.8553 | −0.2654 | 48.544 | 0.9193 | −0.8307 | 49.742 |
| 0.785 | −0.6215 | 47.357 | 0.6295 | −0.3698 | 48.544 | 1.1946 | −0.991 | 49.742 |
| 1.0751 | −1.0805 | 47.357 | 0.8945 | −0.3427 | 48.544 | 0.6052 | −0.3093 | 49.742 |

| X(70%) | Y(70%) | Z(70%) | X(80%) | Y(80%) | Z(80%) | X(90%) | Y(90%) | Z(90%) |
|---|---|---|---|---|---|---|---|---|
| 0.5694 | −0.2993 | 47.357 | 0.9141 | −0.8258 | 48.544 | 1.2255 | −1.3567 | 49.742 |
| 1.3177 | −1.4775 | 47.357 | 1.1598 | −0.8882 | 48.544 | 0.7533 | −0.0778 | 49.742 |
| 1.2774 | −1.4712 | 47.357 | 1.1988 | −0.9665 | 48.544 | 0.7246 | −0.5039 | 49.742 |
| 1.3922 | −1.3364 | 47.357 | 0.9539 | −0.8913 | 48.544 | 0.8298 | −0.2288 | 49.742 |
| 1.4365 | −1.4483 | 47.357 | 0.7754 | −0.1116 | 48.544 | 1.1231 | −0.8378 | 49.742 |
| 1.3542 | −1.2661 | 47.357 | 1.3075 | −1.2017 | 48.544 | 0.9578 | −0.8963 | 49.742 |
| 1.1967 | −1.2787 | 47.357 | 1.3443 | −1.2802 | 48.544 | 0.8806 | −0.7652 | 49.742 |
| 1.3407 | −1.5 | 47.357 | 1.2915 | −1.4414 | 48.544 | 0.9047 | −0.3802 | 49.742 |
| 1.2779 | −1.0955 | 47.357 | 1.2688 | −1.4186 | 48.544 | 1.1111 | −1.1592 | 49.742 |
| 1.403 | −1.5009 | 47.357 | 1.3875 | −1.3901 | 48.544 | 0.7918 | −0.1532 | 49.742 |
| 1.1157 | −1.1465 | 47.357 | 1.3225 | −1.4501 | 48.544 | 0.6851 | −0.4389 | 49.742 |
| 1.2013 | −0.9351 | 47.357 | 1.3775 | −1.4208 | 48.544 | 1.0511 | −0.6849 | 49.742 |
| 1.2397 | −1.0153 | 47.357 | 1.3539 | −1.4426 | 48.544 | 0.8675 | 0.3043 | 49.742 |
| 1.4303 | −1.4167 | 47.357 | 1.1905 | −1.2866 | 48.544 | 1.3339 | −1.3596 | 49.742 |
| 1.3161 | −1.1758 | 47.357 | 1.2706 | −1.1233 | 48.544 | 1.248 | −1.3798 | 49.742 |
| 1.2372 | −1.1345 | 47.357 | 1.2337 | −1.0449 | 48.544 | 1.3102 | −1.3814 | 49.742 |
| 1.3718 | −1.5086 | 47.357 | 1.1512 | −1.2206 | 48.544 | 1.2789 | −1.3887 | 49.742 |
| 1.1563 | −1.2125 | 47.357 | 1.3811 | −1.3588 | 48.544 | 1.3439 | −1.3289 | 49.742 |
| 1.4266 | −1.479 | 47.357 | 1.2296 | −1.3526 | 48.544 | 1.3375 | −1.2974 | 49.742 |

It will also be appreciated that the airfoil disclosed in the above table may be scaled up or down geometrically for use in other similar turbine designs. Consequently, the coordinate values set forth in Table I may be scaled upwardly or downwardly such that the airfoil section shape remains unchanged. A scaled version of the coordinates in Table I would be represented by X, Y and, optionally, Z coordinate values multiplied or divided by the same constant or number.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket including a bucket airfoil having an airfoil shape, said airfoil having nominal profile ranging from 10–90% span of the airfoil height substantially in accordance with Cartesian coordinate values of X, Y and Z set forth in Table I wherein Z is a distance in inches from and perpendicular to a plane passing through an axis of rotation of the turbine and wherein X and Y are distances in inches which, when connected by smooth continuing arcs, define airfoil profile sections at each distance Z, the profile sections at the Z distance being joined smoothly with one another to form the complete airfoil shape.

2. A turbine bucket according to claim 1 forming part of a second stage of a turbine.

3. A turbine bucket according to claim 1 wherein said airfoil shape lies in an envelope within ±0.016 inches in a direction normal to any airfoil surface location.

4. A turbine bucket according to claim 1 wherein the airfoil has a shroud adjacent a tip of the airfoil.

5. A turbine bucket including a bucket airfoil having an airfoil shape, said airfoil having an uncoated nominal airfoil profile ranging from 10–90% span of the airfoil height substantially in accordance with Cartesian coordinate values of X, Y and Z set forth in Table I wherein Z is a distance in inches from and perpendicular to a plane passing through an axis of rotation of the turbine and wherein X and Y are distances in inches which, when connected by smooth continuing arcs, define airfoil profile sections at each distance Z, the profile sections at the Z distances being joined smoothly with one another to form the complete airfoil shape, the X and Y distances being scalable as a function of the same constant to provide a scaled-up or scaled-down bucket airfoil.

6. A turbine bucket according to claim 5 forming part of a second stage of a turbine.

7. A turbine bucket according to claim 5 wherein said airfoil shape lies in an envelope within ±0.016 inches in a direction normal to any airfoil surface location.

8. A turbine bucket according to claim 5 wherein the airfoil has a shroud adjacent a tip of the airfoil.

9. A turbine comprising a turbine wheel having a plurality of buckets, each of said buckets including a bucket airfoil having an airfoil shape, said airfoil having a nominal profile ranging from 10–90% span of the airfoil height substantially in accordance with Cartesian coordinate values of X, Y and Z set forth in Table I wherein Z is a distance in inches from and perpendicular to a plane passing through an axis of rotation of the turbine axis and wherein X and Y are distances in inches which, when connected by smooth continuous arcs, define airfoil profile sections at each distance Z, the profile sections at the Z distances being joined smoothly with one another to form the complete airfoil shape.

10. A turbine according to claim 9 wherein the turbine wheel comprises a second stage of the turbine.

11. A turbine according to claim 9 wherein the turbine wheel has 92 buckets and X represents a distance parallel to the turbine axis of rotation.

12. A turbine according to claim 9 wherein each said airfoil shape lies in an envelope within ±0.016 inches in a direction normal to any airfoil surface location.

13. A turbine according to claim 9 wherein the turbine wheel comprises a second stage of the turbine, each said airfoil shape lying in an envelope within ±0.016 inches in a direction normal to any airfoil surface location.

14. A turbine according to claim 9 wherein the turbine wheel comprises a second stage of the turbine, the turbine wheel having 92 buckets and X represents a distance parallel to the turbine axis of rotation.

15. A turbine comprising a turbine wheel having a plurality of buckets, each of said buckets including a bucket airfoil having an airfoil shape, said airfoil having a nominal profile ranging from 10–90% span of the airfoil height substantially in accordance with Cartesian coordinate values of X, Y and Z set forth in Table I wherein Z is a distance in inches from and perpendicular to a plane passing through an axis of rotation of the turbine and wherein X and Y are distances in inches which, when connected by smooth continuous arcs, define airfoil profile sections at each distance Z, the profile sections at the Z distances being joined smoothly with one another to form the complete airfoil shape, the X and Y distances being scalable as a function of the same constant to provide a scaled-up or scaled-down bucket airfoil.

16. A turbine according to claim 15 wherein the turbine wheel comprises a second stage of the turbine.

17. A turbine according to claim 15 wherein the turbine wheel has 92 buckets and X represents a distance parallel to the turbine axis of rotation.

18. A turbine according to claim 15 wherein each said airfoil shape lies in an envelope within ±0.016 inches in a direction normal to any airfoil surface location.

19. A turbine according to claim 15 wherein the turbine wheel comprises a second stage of the turbine, each said airfoil shape lying in an envelope within ±0.016 inches in a direction normal to any airfoil surface location.

20. A turbine according to claim 15 wherein the turbine wheel comprises a second stage of the turbine, the turbine wheel having 92 buckets and X represents a distance parallel to the turbine axis of rotation.

* * * * *